US007779491B1

(12) United States Patent
Warren

(10) Patent No.: US 7,779,491 B1
(45) Date of Patent: Aug. 24, 2010

(54) CONVERTIBLE SUPPORT APPARATUS

(76) Inventor: Bruce Arthur Warren, 2307 Whitetail La., Lake Jackson, TX (US) 77566

( * ) Notice: Subject to any disclaimer, the term of this patent is extended or adjusted under 35 U.S.C. 154(b) by 262 days.

(21) Appl. No.: 12/051,820

(22) Filed: Mar. 19, 2008

(51) Int. Cl.
*A47C 17/64* (2006.01)

(52) U.S. Cl. ..... 5/112; 5/111; 5/187; 5/110

(58) Field of Classification Search ..... 5/110–117, 5/187

See application file for complete search history.

(56) References Cited

U.S. PATENT DOCUMENTS 4,688,281 A * 8/1987 Lantz ..... 5/111

* cited by examiner

*Primary Examiner*—Fredrick Conley
(74) *Attorney, Agent, or Firm*—Michael D. Eisenberg

(57) ABSTRACT

A convertible support apparatus for supporting an object over a ground surface is convertible between an operating configuration and a storage configuration. The support apparatus may comprise side members, a support area configured to connect to the side members, and a bow truss configured to bow. When the device is assembled in the operating configuration, both the support area and the bow truss are connected between the side members and the bow truss is configured to bow and place the support area under tension. The bow truss may comprise a bow tube connected between two foot fixtures. In one embodiment, when the apparatus is supporting a sufficiently heavy object, the bow tube will bow and contact the ground surface and provide additional support to the apparatus.

13 Claims, 17 Drawing Sheets

CONVERTIBLE SUPPORT APPARATUS

TECHNICAL FIELD

The present invention relates to a support apparatus, and more particularly, some embodiments relate to a bed convertible between an operating configuration and a storage configuration.

BACKGROUND OF THE INVENTION

A large variety of beds for outdoor sleeping are available on the market. Outdoor portable beds are generally used for camping, sleeping in rustic settings, or for relaxing at places like the beach. Most outdoor beds fold in some manner to make storage and carrying easier. Such beds are usually constructed with a metallic or wood frame with a fabric membrane stretched tightly across the frame as the sleep surface and are usually called cots. The alternatives to cots for camping are foam pads, air mattresses, and hammocks. Cots are generally considered to be more comfortable than foam pads or air mattresses, but are usually much heavier. Backpackers, motorcycle riders, kayakers, bicyclists rarely carry cots since they are too large, even when folded, and are too heavy. Lightweight travelers would like to have a comfortable bed that was as lightweight as a foam pad and folds down to a small size to fit in a backpack. However, cots are typically about 12 inches tall and 7 feet long and will not fit inside a typical lightweight camping tent. Hammocks can be small and light, but require two trees or poles to function. Many camping sites have no trees or poles. Hammocks also deliver a very curved sleeping surface that is not at all like the planar bed at home, causing most users to be unable to sleep well.

Beach visitors may prefer a bed that is compact in the car and comfortable on the beach. Families with limited space may like to have an easy to store spare bed for overnight guests. A common complaint from users of cots is that they stretch and collapse. This happens because the tubular frame design is easy to accidentally overstress. Common fabrics will gradually stretch to the point of sagging to the ground. Since the bed is a foot above the floor, it is easy for a heavy person to produce stresses that break the frame or tear the fabric. Therefore, there is a need for an improved support apparatus for persons and other objects.

BRIEF SUMMARY OF EMBODIMENTS OF THE INVENTION

According to one embodiment of the invention, a convertible support apparatus for supporting an object over a surface is convertible between an operating configuration and a storage configuration. The support apparatus may comprise side members; a support area configured to connect to the side members; and a bow truss configured to bow and flex when connected between the support members. The bow truss comprises a first bow tube connected between two foot fixtures. When the device is assembled in the operating configuration, both the support area and the bow truss are connected between the side members and the bow truss is configured to bow and place the support area under tension. When the apparatus is placed on a ground surface in the operating configuration without the object, the two foot fixtures are configured to touch the ground surface and the bow tube is configured to suspend over the ground surface out of physical contact with the ground surface. When the support area is loaded with the object, the bow tube will deflect. If the object is heavy enough, the bow tube will deflect downward enough to contact the ground surface.

In another embodiment of the convertible support apparatus, the support area is flexible and the foot fixture has a first void and a second void. The first void may be configured to receive a plurality of bow tubes and a plurality of side members and the second void may be configured to receive the support area. In a preferred method of use, the two voids receive the bow tubes, side members and support area when the support apparatus is in a stowed configuration. In an alternative embodiment, the foot fixture has a single void configured to receive a plurality of bow tubes, a plurality of side members and the support area when the support apparatus is in a stowed configuration.

In a further embodiment, the convertible support apparatus has at least two foot fixtures for contacting a support surface. When the support apparatus is assembled in the operating configuration and supporting a sufficiently heavy object, the foot fixtures are configured to support the apparatus on the ground surface and the bow tube is configured to bow and contact the ground surface beneath the foot fixtures, thus providing an additional contact point for supporting the object.

In another embodiment, the apparatus is configured such that when placed on a flat ground surface, the foot fixtures touch the ground surface and support the apparatus and the bow tube is configured to contact the ground surface and support the apparatus.

In still another embodiment, the apparatus has a second bow tube disposed adjacent to the first bow tube and connectable to the foot fixtures. In another alternative embodiment, the second bow tube may be twisted around the first bow tube.

In yet a further embodiment, the bow tube comprises a female member and a male member receivable into the female member and the foot fixture configured to receive the bow tube.

In another embodiment, the foot fixture has a hook configured to connect the foot fixture to the side member.

In a further embodiment, the support area is flexible and the apparatus is configured to support the object at a height over the ground surface and the apparatus weighs less than 1% of the weight of the object it is configured to support.

In still another embodiment, an apparatus for supporting objects or persons includes two spaced apart side members; a support area connected between the side members; and a first bow truss connected between the side members. The bow truss is comprised of a first bow tube connected between two foot fixtures. The bow tube is configured to bow when the bow truss is connected between the side members, bias the side members apart, and place the support area under tension. In one embodiment, the apparatus may be convertible between an operating configuration and a storage configuration.

In yet a further embodiment, a method of supporting an object over a ground surface includes suspending a flexible support area between two side members; connecting at least two foot fixtures to the side members, so that the foot fixtures support the side members over a ground surface; and connecting a bow tube between the foot fixtures.

In another embodiment, the method of supporting an object over a ground surface of may further comprise bowing the bow tube so that it contacts the ground surface using the weight of the object on the flexible support area.

In a further embodiment, the method of supporting an object over a ground surface may include: connecting first ends of two bow tubes into a first foot fixture; connecting second ends of the two bow tubes into a second foot fixture; and rotating one of the foot fixtures by 180 degrees.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
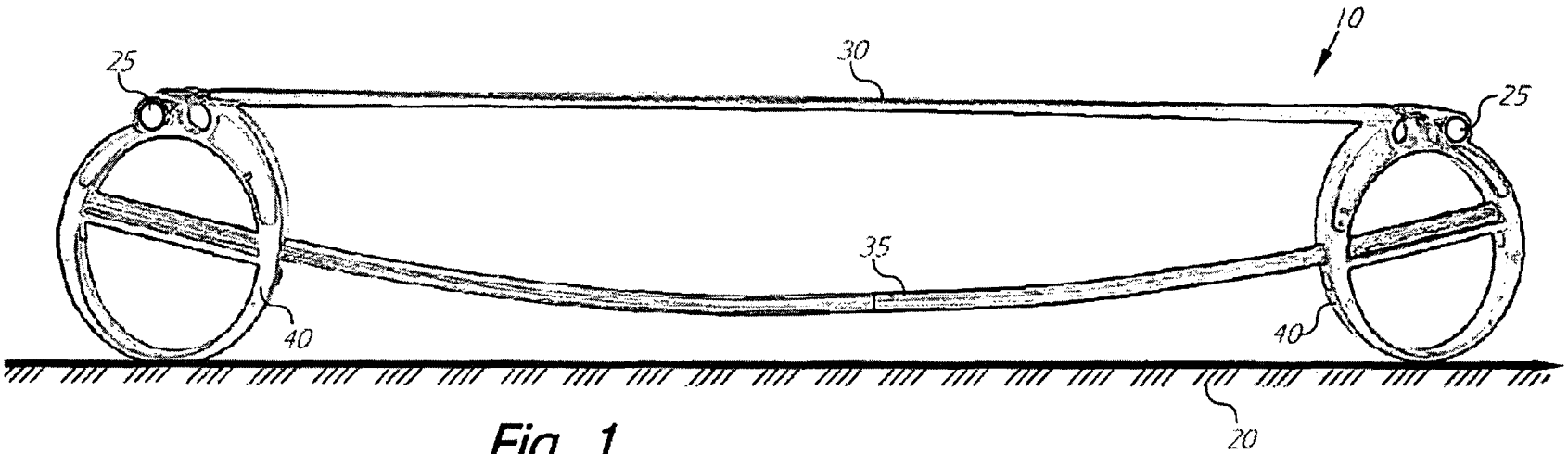
FIG. 1 is an illustration of a preferred convertible support apparatus in accordance with the principles of the invention.
Figure 2:
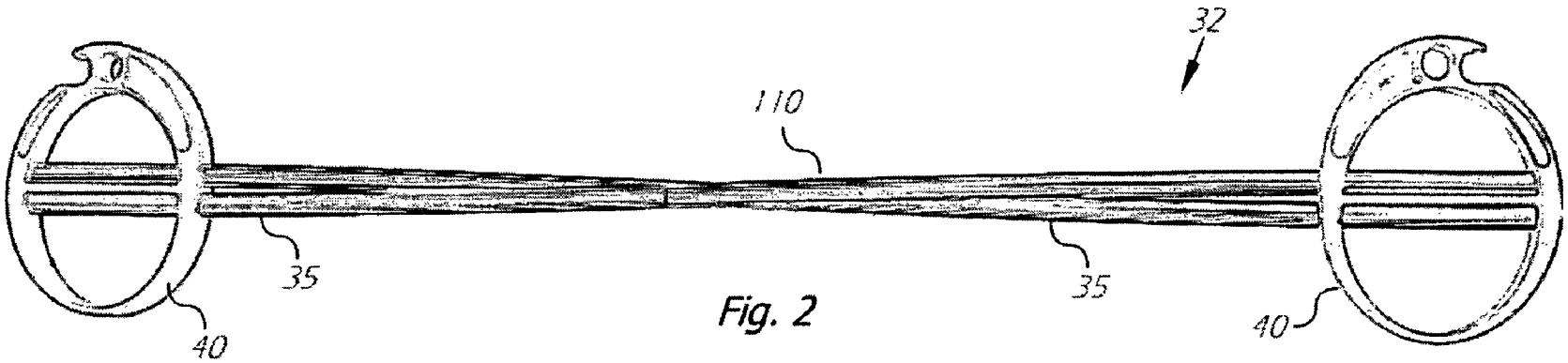
FIG. 2 is perspective view of two bow tubes twisted about one another.
Figure 3:
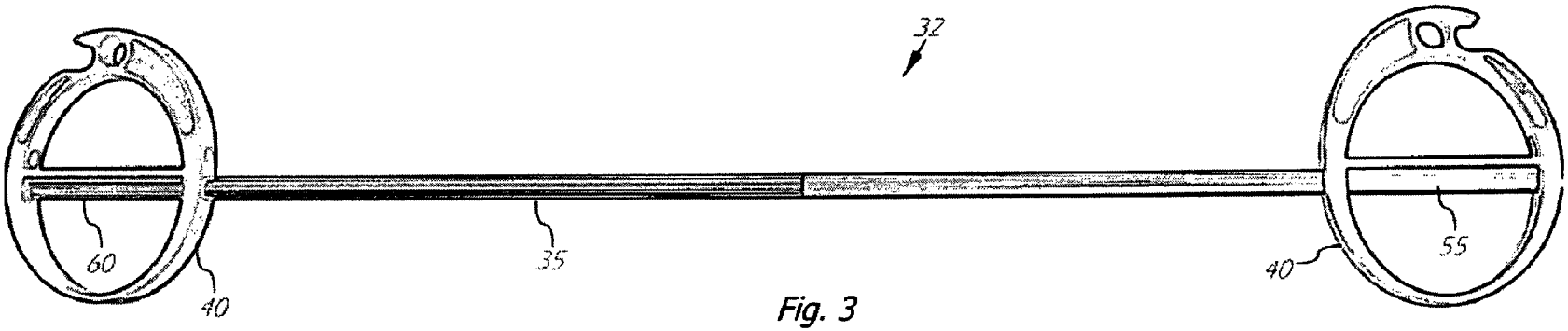
FIG. 3 is a perspective view of a single bow tube connected between two foot fixtures.
Figure 4:
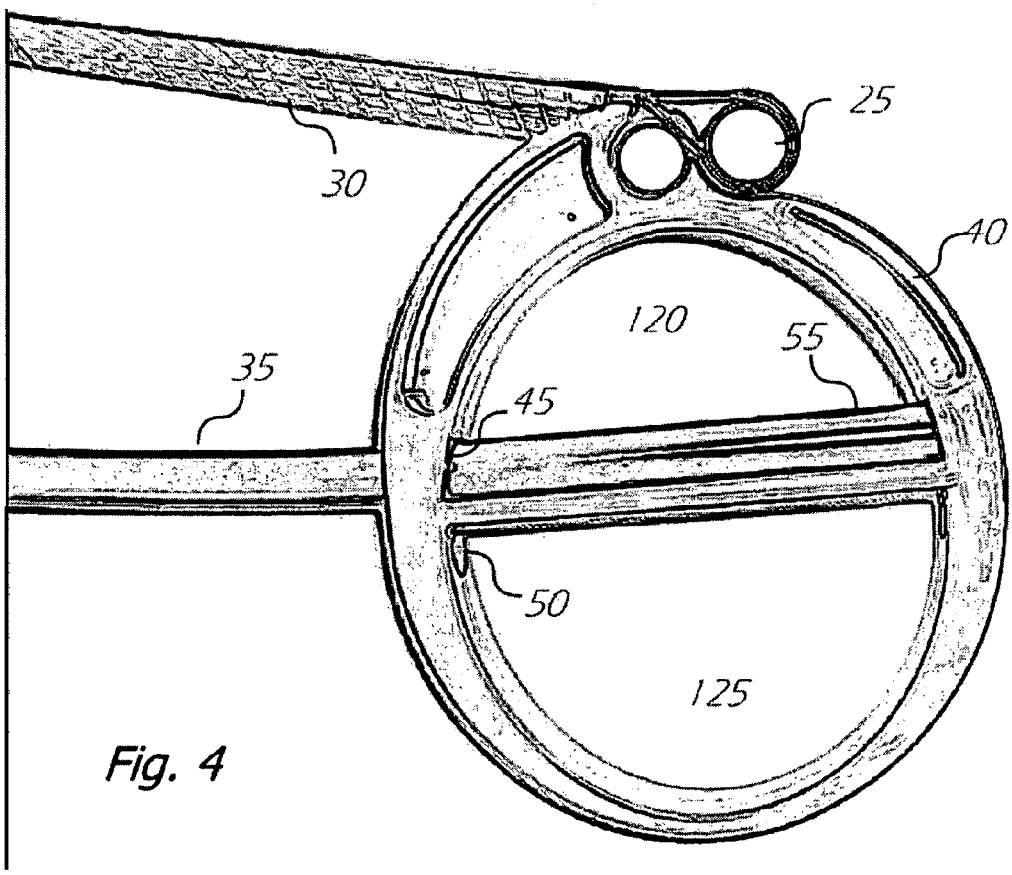
FIG. 4 is a more detailed view of a single bow truss connected to a side member via a foot fixture.
Figure 5:
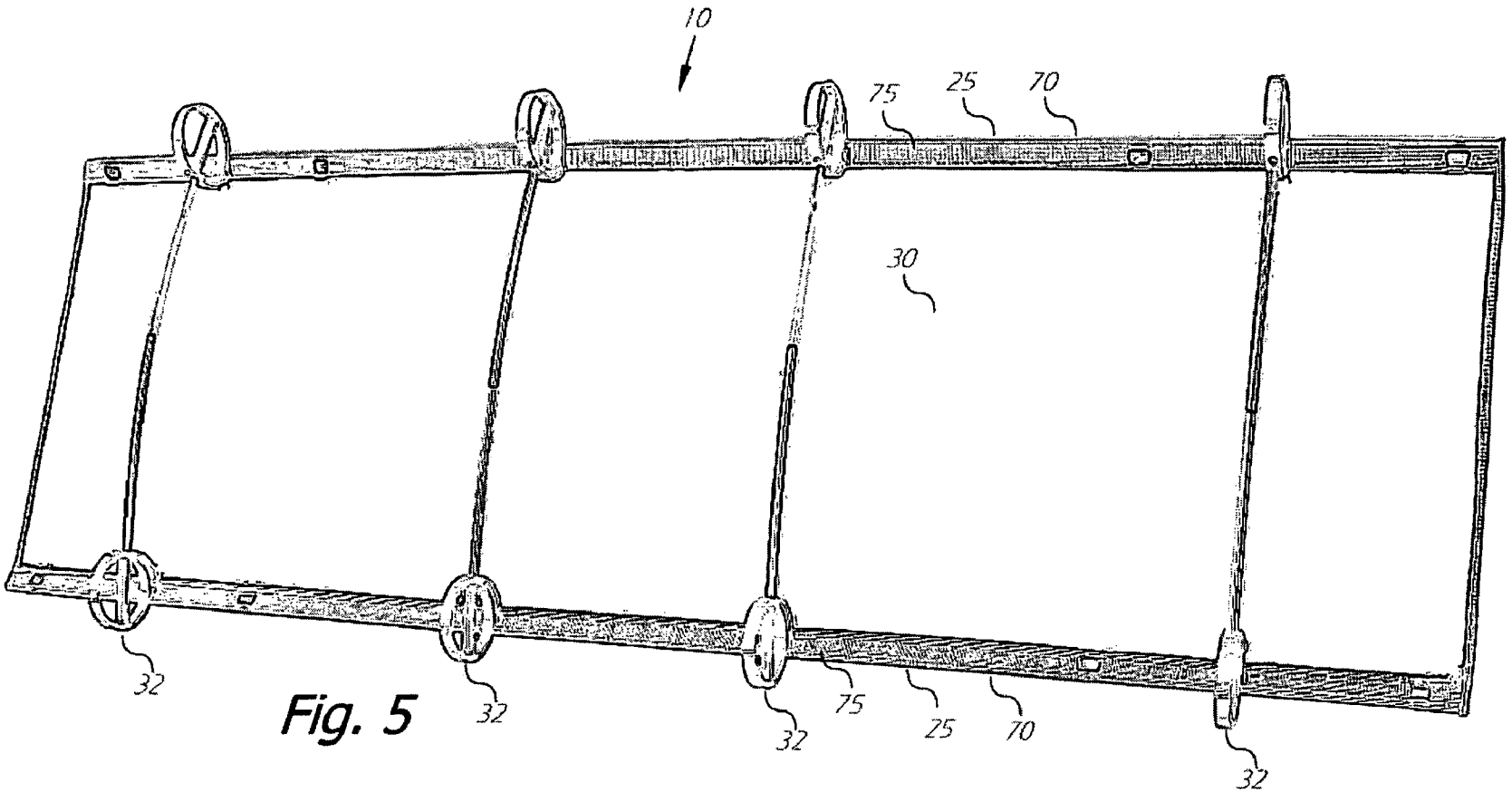
FIG. 5 is a perspective view of a support apparatus configured to support lighter weights or persons, where each bow truss utilizes a single bow tube connected between the foot fixtures.
Figure 6:
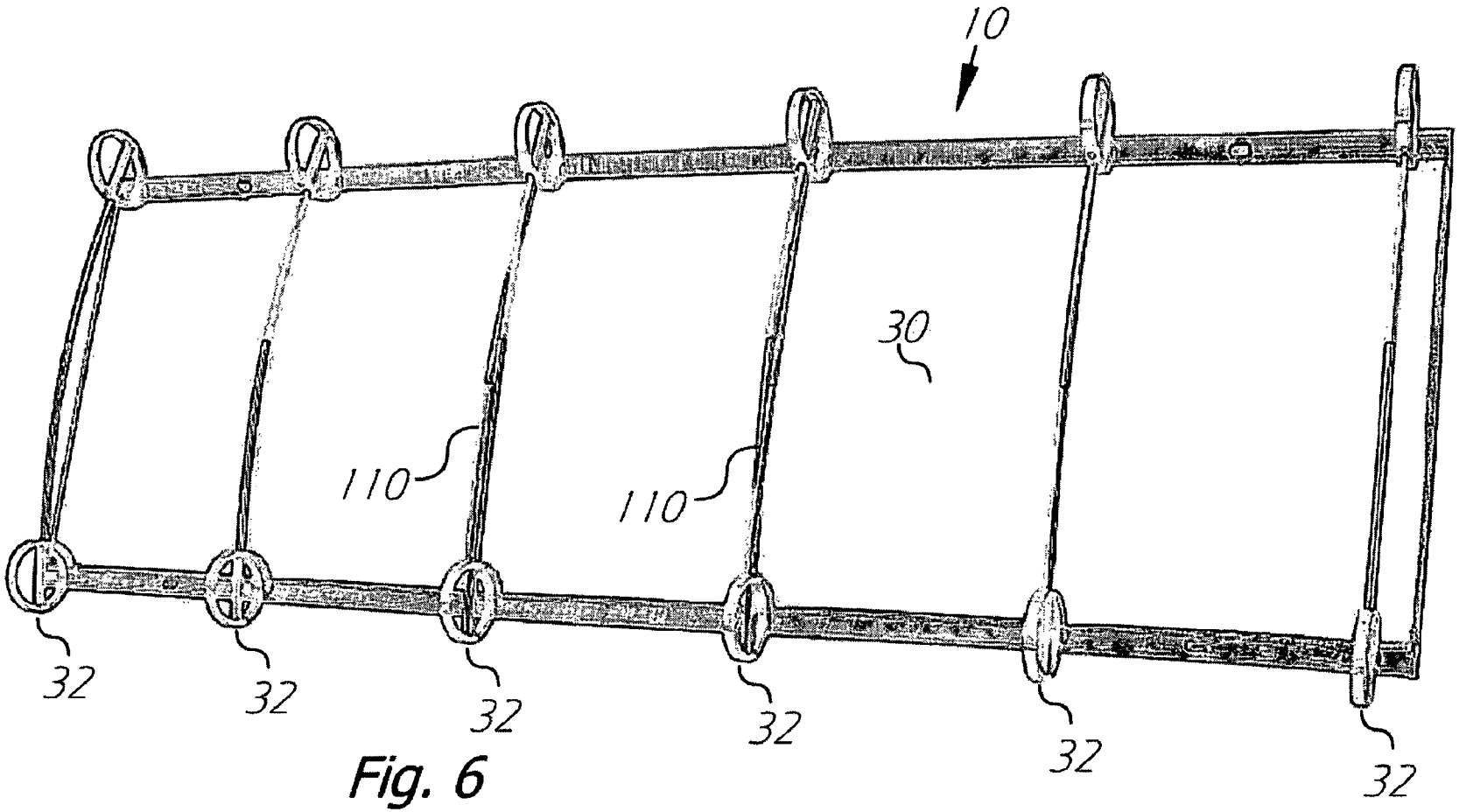
FIG. 6 is a perspective view of a support apparatus configured to support heavier weights or persons, having some bow trusses with two bow tubes connected between them.
Figure 7:
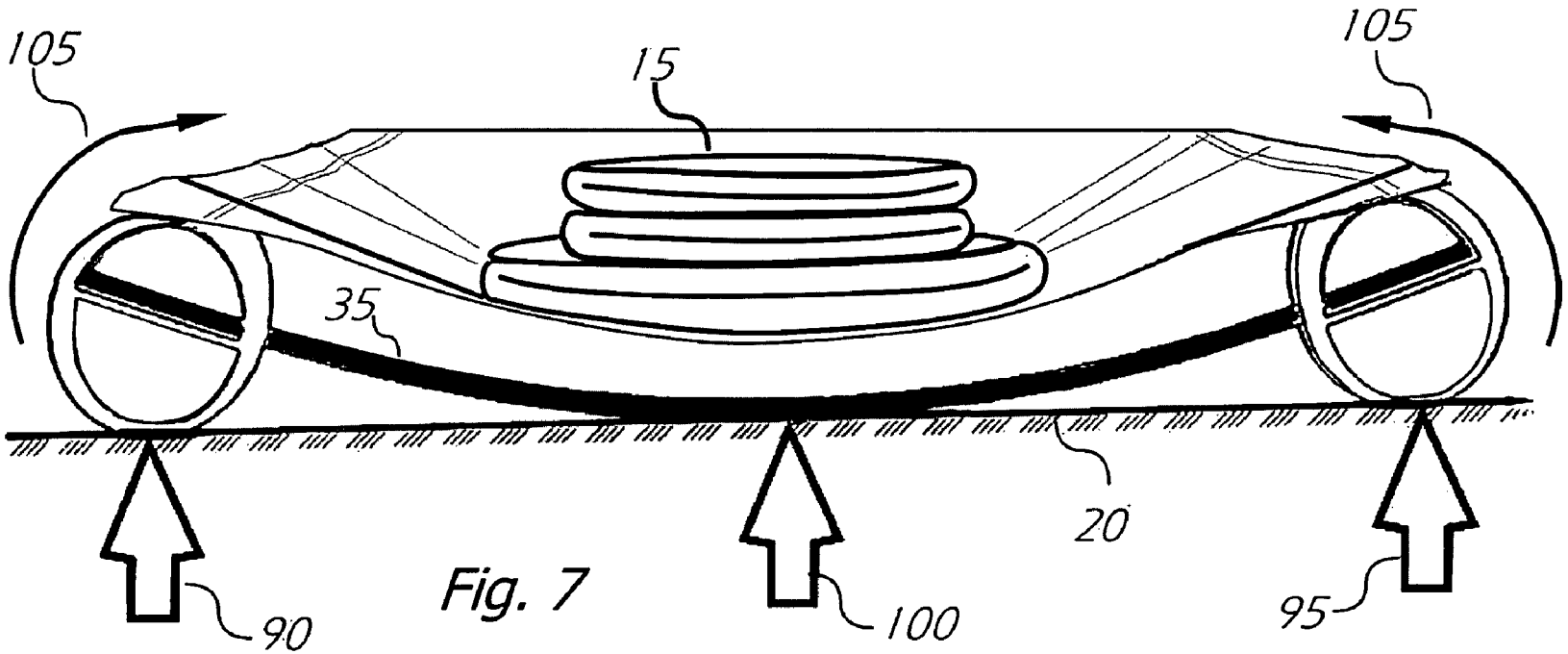
FIG. 7 is a diagram illustrating how one embodiment of the apparatus operates.
Figure 11:
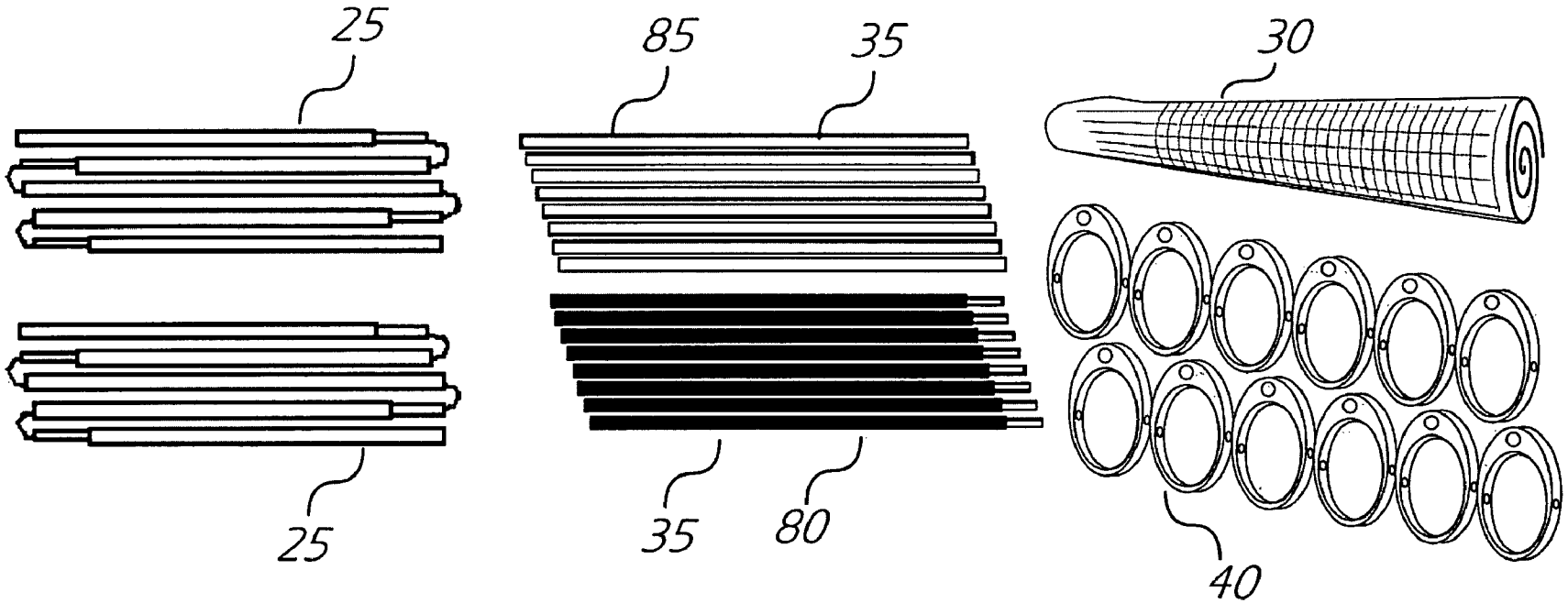
FIG. 11 is an illustration of the support apparatus in a storage or disassembled configuration.
Figure 12:
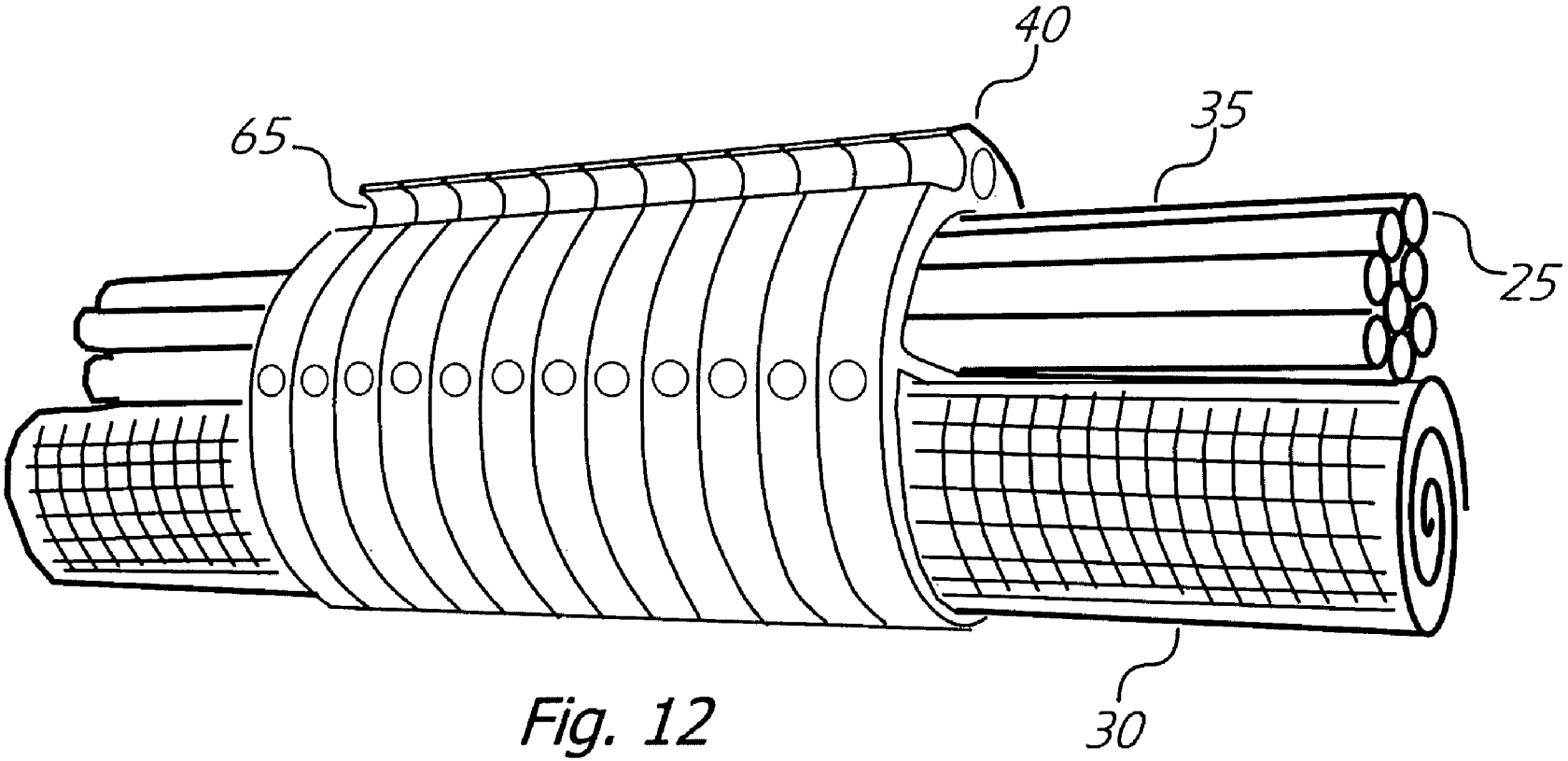
FIG. 12 is a perspective view of the support apparatus in a preferred storage configuration.

Referring to FIGS. 1, 5 and 7 the present invention is directed toward a convertible support apparatus 10 for supporting an object 15 or a person over a ground surface 20. The convertible support apparatus 10 is convertible between an operating configuration, shown in FIGS. 1, 5 and 6, and a storage configuration. In a preferred embodiment, the storage configuration is shown in FIG. 12, however, the term, "storage configuration," generally refers to the support apparatus disassembled from the operating configuration. Thus, there are virtually an unlimited number of storage configurations, for example FIG. 11 is another storage configuration. The support apparatus 10 may comprise side members 25 and a support area 30 configured to connect to the side members 25. The apparatus 10 also includes a bow truss 32, as illustrated in FIGS. 2 and 3, and is configured to resiliently bow and flex. When the apparatus is assembled in the operating configuration, both the support area 30 and the bow trusses 32 are connected between the side members 25 and the bow trusses 32 are configured to bow and place the support area 30 under tension. In one embodiment, referring to FIGS. 3 and 4, the bow truss 32 further comprises a bow tube 35 connected between two foot fixtures 40 and the foot fixtures are configured to connect the bow truss 32 to a side member 25.

Figure 8:
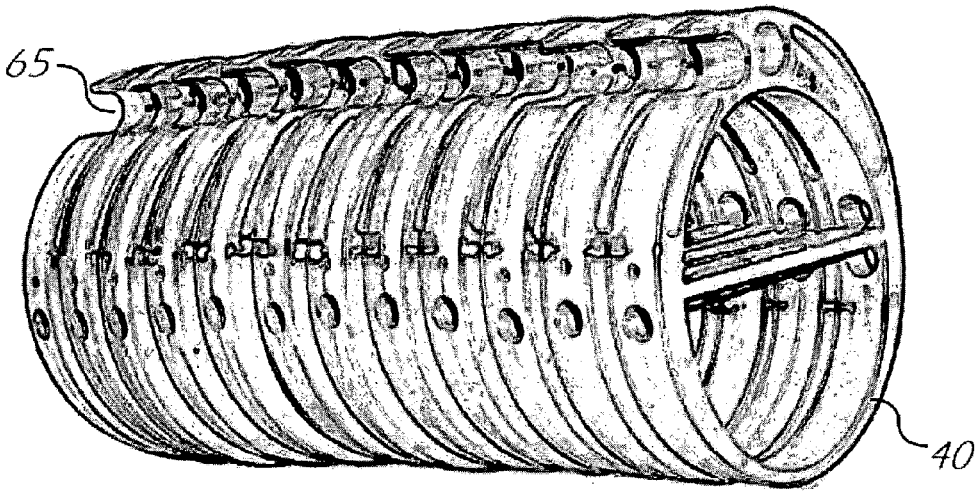
FIG. 8 is perspective view of a plurality of foot fixtures in a storage configuration.
Figure 15:
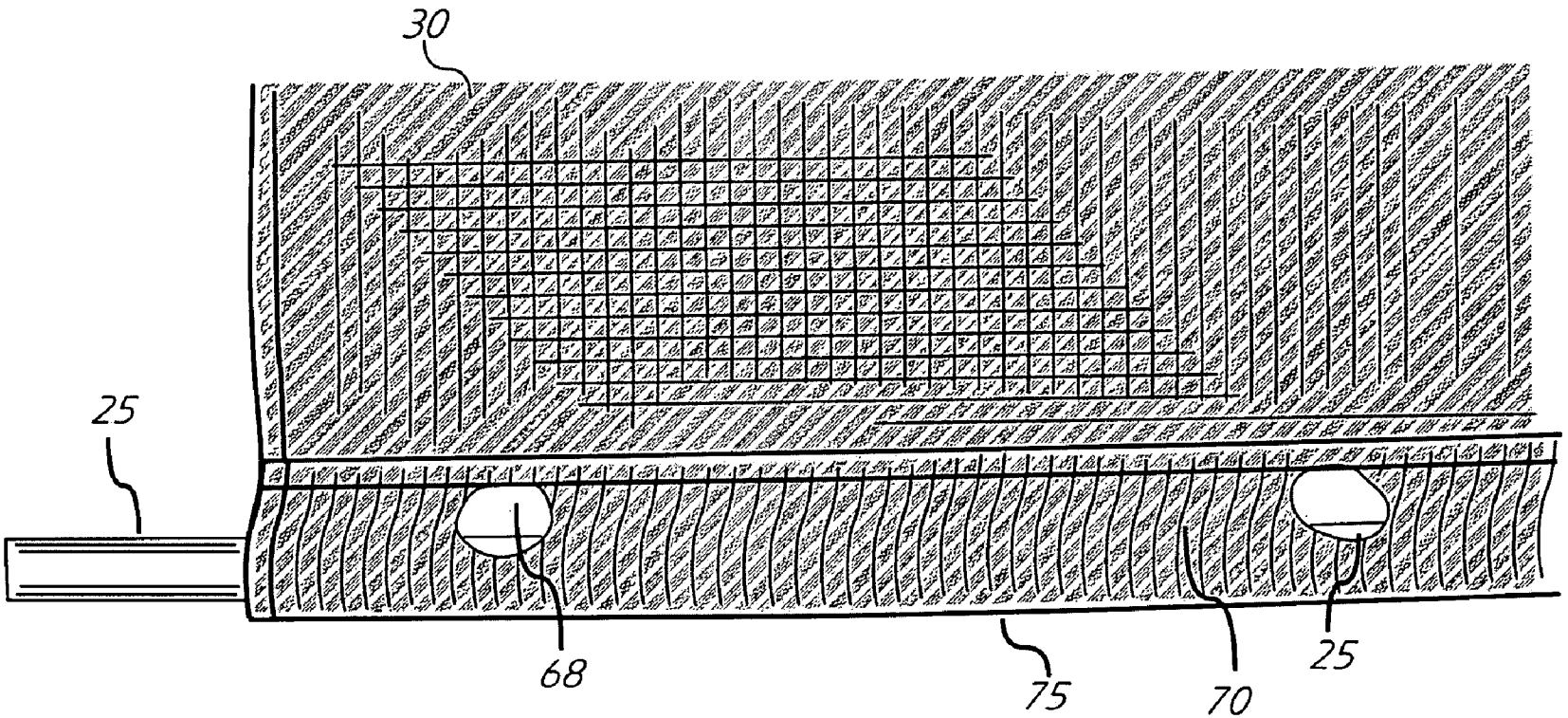
FIG. 15 is an illustration of the sleeve along each side of the support area and openings in the sleeve to accept the foot fixture when connected to the side member.

Referring to FIG. 4, in a preferred embodiment, the foot fixture 40 typically has a circular or oval cross-section and may be about 5 inches in height. The foot fixture 40 may be an injection molded plastic ring. The foot fixture 40 may have first 45 and second 50 holes to allow an end 55 of a bow tube to be inserted therein, parallel to the plane of the foot. When the other end 60 of the bow tube is inserted into a first 45 or second 50 hole of another foot fixture 40, as illustrated in FIG. 3, the two feet 40 are held a fixed distance apart. Referring to FIGS. 8 and 12, the foot fixture 40 has a hook 65 located at a top of the foot fixture 40. The hook 65 is configured to clip onto the side member 25 and, in one embodiment, referring to FIG. 15, clip to a side member 25 that has been inserted into a sleeve 70 of the support area 30, through a window 68 of the sleeve 70.

Referring to FIGS. 5 and 6, the support apparatus 10 may serve as a bed for persons to sleep on. In one embodiment, the support area 30 may be comprised of a fabric panel 30 tensioned between two side members 25 or poles that are supported by a plurality of bow trusses 32. The fabric panel 30 can be made from any low stretch fabric but is preferably sewn from composite fabric made for sails on racing sailboats to achieve the lowest weight. The fabric panel 30 has dimensions that can be varied to suit the application, but may in one example be about 25 inches wide and 75 inches long to accommodate adult human body sizes. The fabric panel 30 may be sewn with a sleeve 70 along the full length of each long side 75 to accommodate a side member 25 or pole that is configured to be inserted therein. In one embodiment, the side pole 25 may be constructed of segments of aluminum or carbon fiber, similar to common tent poles, to allow it to be disassembled and stored in a compact form, for example as shown FIG. 11. The sleeve in the fabric panel may have cutouts or windows 68, and in one example, the windows 68 are spaced every 15 inches to allow the bow trusses 32 to attach across the fabric surface 30 to the side pole 25 on each side 75.

Figure 10:
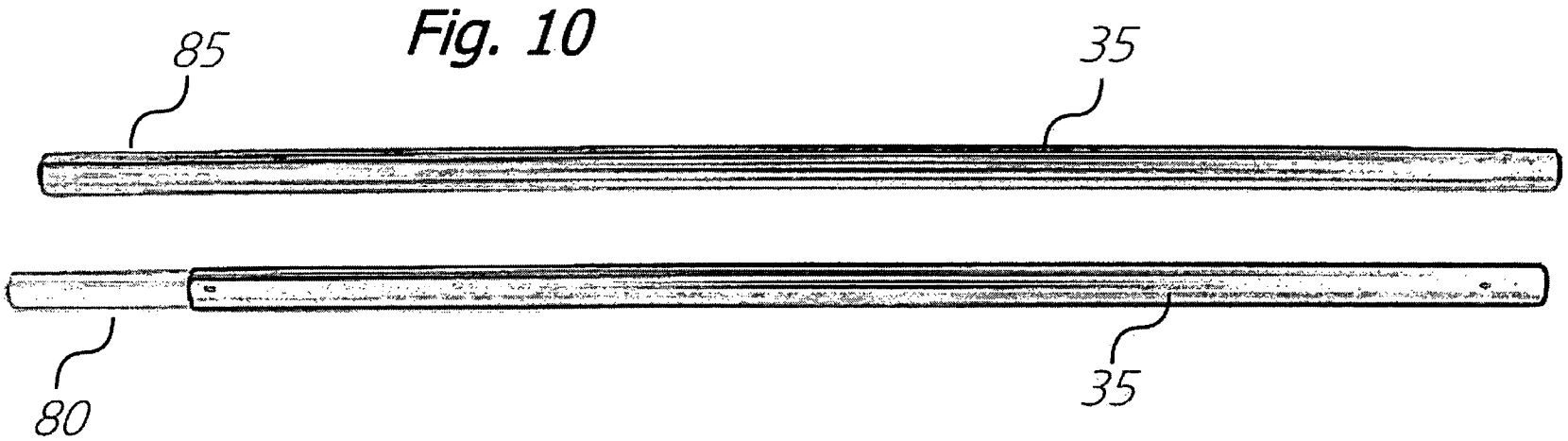
FIG. 10 is a perspective view of male and female sections of a bow tube.

Referring to FIGS. 3, 5 and 6, in one example embodiment, a plurality of bow trusses 32, typically from four to six in number, are used to bias the two side poles 25 apart and create a side-to-side tension in the fabric panel 30. In the present example, there are no structural members that provide tension in the lengthwise direction, although other embodiments might include such a feature. Each bow truss 32 may be comprised of a small diameter connecting tube 35 and be connected to a removable foot fixture 40 at each end. The bow tubes 35 can be made from aluminum, titanium, carbon fiber, or other light but strong material. For ease of transporting, illustrated in FIG. 10, the bow tubes 35 may comprise two sections, a male section 80 that is receivable into a female section 85, such as a tent pole tube.

Referring to FIG. 7, the width of the fabric 30 between the two side poles 25 is less than the unbent length of the bow truss 32. Thus, to alter the horizontal distance between the two feet 40 one bends the bow truss 32. This can be achieved by, for example, if a sufficient weight 15 is placed on the support area 30. The bow truss 32 be must be bent in order to clip a foot 40 onto a side tube 25. The bend in the bow truss 32 produces tension in the fabric panel 30. However, this tension alone may not be sufficient to support an adult human body. To deliver a high level of tension, the bow truss should preferably be placed on a sold surface, like the ground. When resting on a flat surface and if sufficiently tensioned, the bow truss 32 will touch the ground at three places 90, 95, 100 which include the two feet 90, 95 and the center 100 of the bow tube 35, which is bowed down when the support apparatus 10 is assembled in an operating configuration.

If a person lies down on the support apparatus 10 or a sufficient weight 15 is placed thereon, the fabric panel 30 is pushed downward, creating tension which pulls the two side poles 25 together. This force attempts to rotate 105 both feet inward. This rotation 105 bends the bow tube 35 downward where it touches the ground surface 20 in its middle 100. The contact with the ground surface 20 shortens the beam length of the bow tube 35 by 50%, increasing its effective stiffness by a factor of nine. This produces a dramatic increase in the resistance of the foot 40 to rotation, thus increasing the tension of the fabric panel 30.

In one embodiment, the dimensions of the support apparatus 10 are optimized such that a prone body results in the bow tube 35 bending and the fabric panel 30 deflecting such that the buttocks almost touch the ground. Structural failure of the bow trusses 32, side poles 25 or feet 40 may be prevented by the body touching the ground. Sitting or standing on the apparatus 10 will press the section of the fabric panel 30 being sat or stood on, flat to the ground, limiting the stress on other frame elements. Other apparatus or bed designs that support objects 15 or persons higher off the ground surface 20 require thicker and heavier elements to withstand large point loads without failure, thus becoming very heavy and bulky.

In a further embodiment, each bow truss 32 can be tuned to allow the support area's 30 tension to be set to a lower level for the foot end of the bed, allowing a sleeper's legs to slant down at a more comfortable angle. This can be done by shortening the length of the bow tube 35 or by using feet 40 that have several holes 45, 50 drilled in the wall of the feet 40 allowing the bow tube 35 to be inserted at different initial heights above the ground surface. If the bow tube is inserted in hole 45, the bow tube will initially be positioned higher above the ground surface than if inserted in hole 50. This will allow the fabric support surface to sag more before the center of the bow tube contacts the ground surface, at which point the support tension in the fabric increases by a factor of nine, thus producing a softer feel for the fabric surface. For a higher load bearing zone, a longer bow tube can be used. This will result in the bow tube touching the ground surface with the initial installation of the bow truss producing maximum tension on the fabric surface with the first pound of load weight.

Referring to FIGS. 2 and 6, two bow tubes 110 can be used to double the tension delivered by a single bow tube 35. A relaxed tension at the foot end can also be achieved by adjusting the support area 30 to a wider width as it nears the end of the apparatus 10 configured to support light weight while using a constant length for all the bow trusses 32.

The convertible support apparatus 10 can be assembled with a varying number of bow trusses 32 to accommodate light to heavy objects or people. A short bed for a child may have only three bow trusses. An embodiment for a 300 lb person may have six bow trusses to provide sufficient support. Since being light in weight and being capable of fast setup is valued by most users, the minimum number of bow trusses 32 is desirable for any given weight range. Since the weight of human body is not linearly distributed, the placement of the bow trusses 32 or double tube bow trusses 110 can be matched to the body.

Figure 9:
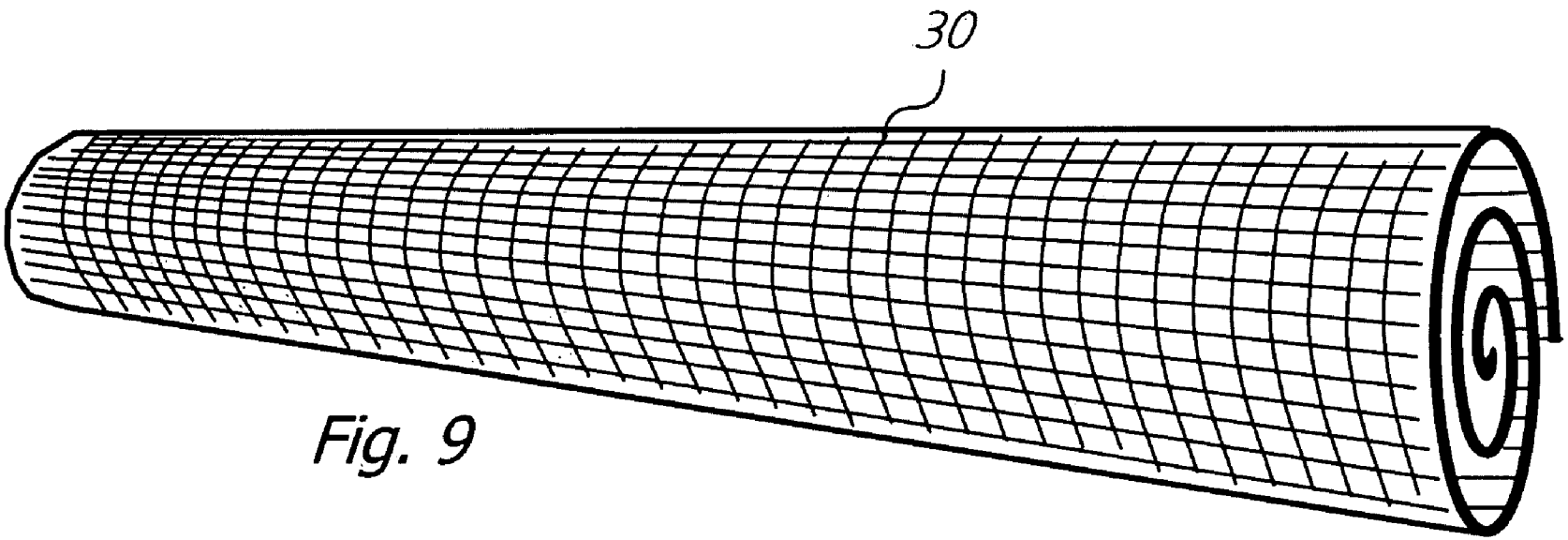
FIG. 9 is a perspective view of a support area in a storage configuration.

The convertible support apparatus can be dissembled and stored in a smaller volume than prior art beds allowing it to be easily carried on bicycles, kayaks, motorcycles and in hiking backpacks. The long side pole that is inserted into the fabric sleeve consists of five segments to allow folding to under 16 inches in length. The segments have an insert that slips inside the neighboring segment to make a very stiff pole. Each bow tube 35 may be comprised of two pieces, male and female, that slip together using an insert connection. In one example, these pieces are individually under 16 inches in length. The fabric component can be folded into a small bundle, illustrated in FIG. 9, that slips inside a tubular stack made from the collection of oval feet, illustrated in FIGS. 8 and 12. Then, the poles and bow tubes 35 can be slipped into the voids in the stacked feet beside the fabric, thus making a very compact package that is approximately 16" long and four inches diameter, for example. Prior art cots have poles and legs made from large cross-section round or square metal tubing or wood. Most such camping cots usually fold in half and some can then be rolled in a bundle of approximately 20 times the stored volume of embodiments of the present invention.

In another embodiment, referring to FIGS. 4, 8 and 12 of the convertible support apparatus, the support area is flexible and the foot fixture has a first void 120 and a second void 125. The first void may be configured to receive a plurality of side members and the second void may be configured to receive the support area and a plurality of bow tubes. In a preferred method of use, the voids receive the bow tubes, side members and support area when the support apparatus is in a stowed configuration. In an alternative embodiment, the foot fixture has a single void configured to receive a plurality of bow tubes, a plurality of side members and the support area when the support apparatus is in a stowed configuration.

Figure 13:
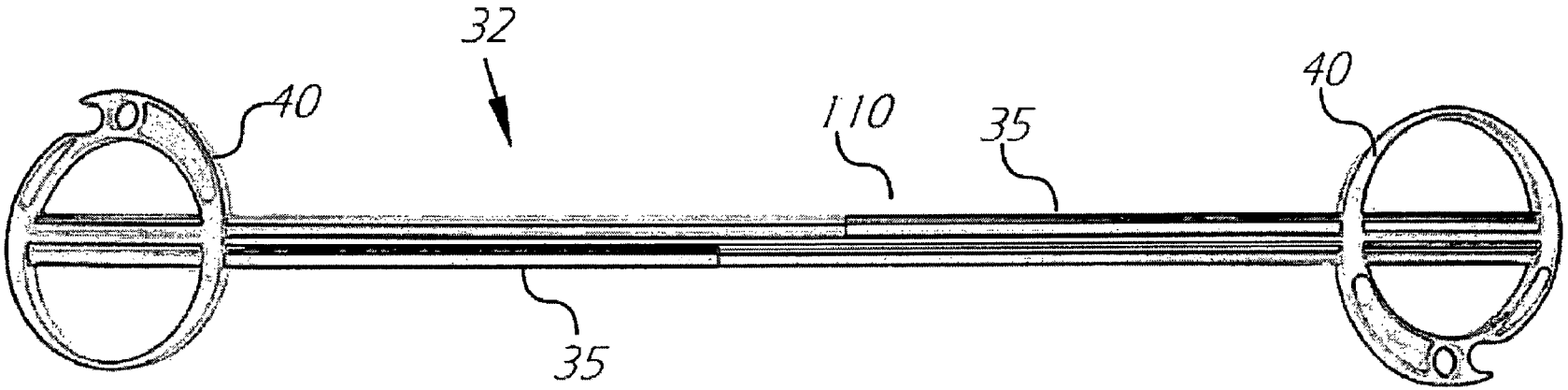
FIG. 13 is an illustration of a bow truss having two bow tubes being prepared to be twisted around one another.

In still another embodiment, referring to FIG. 13, the bow truss 32 has a second bow tube 35 disposed adjacent to the first bow tube 35 and connectable to the foot fixture 40. Alternatively, referring to FIG. 2, the second bow tube 35 may be twisted around the first bow tube 35.

In a further embodiment, the support area is flexible and the apparatus is configured to support the object at a height over the ground surface and the apparatus weighs less than 1% of the weight of the object it is configured to support.

Figure 16:
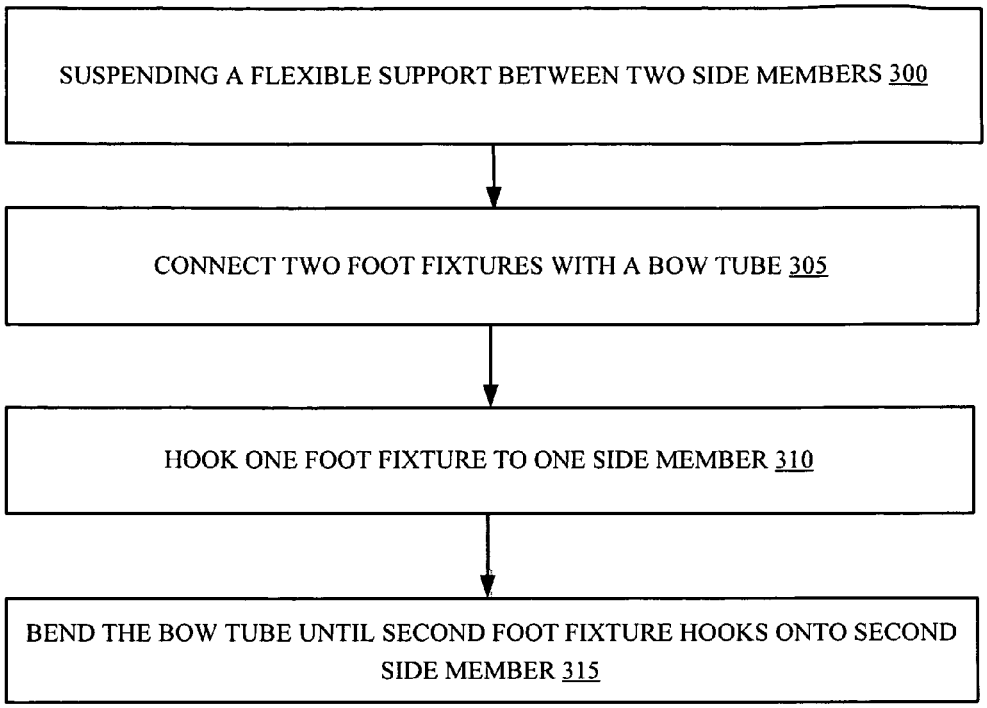
FIG. 16 is a flow chart of a method of supporting an object.

In yet a further embodiment, referring to FIG. 16, a method of supporting an object over a ground surface includes the step 300 of suspending a flexible support between two side members; in a step 305, connecting two foot fixtures with a bow tube, connecting one foot fixture to a side member, and in a step 315 bending the bow to allow the second foot fixture to hook onto the second side member.

Figure 17:
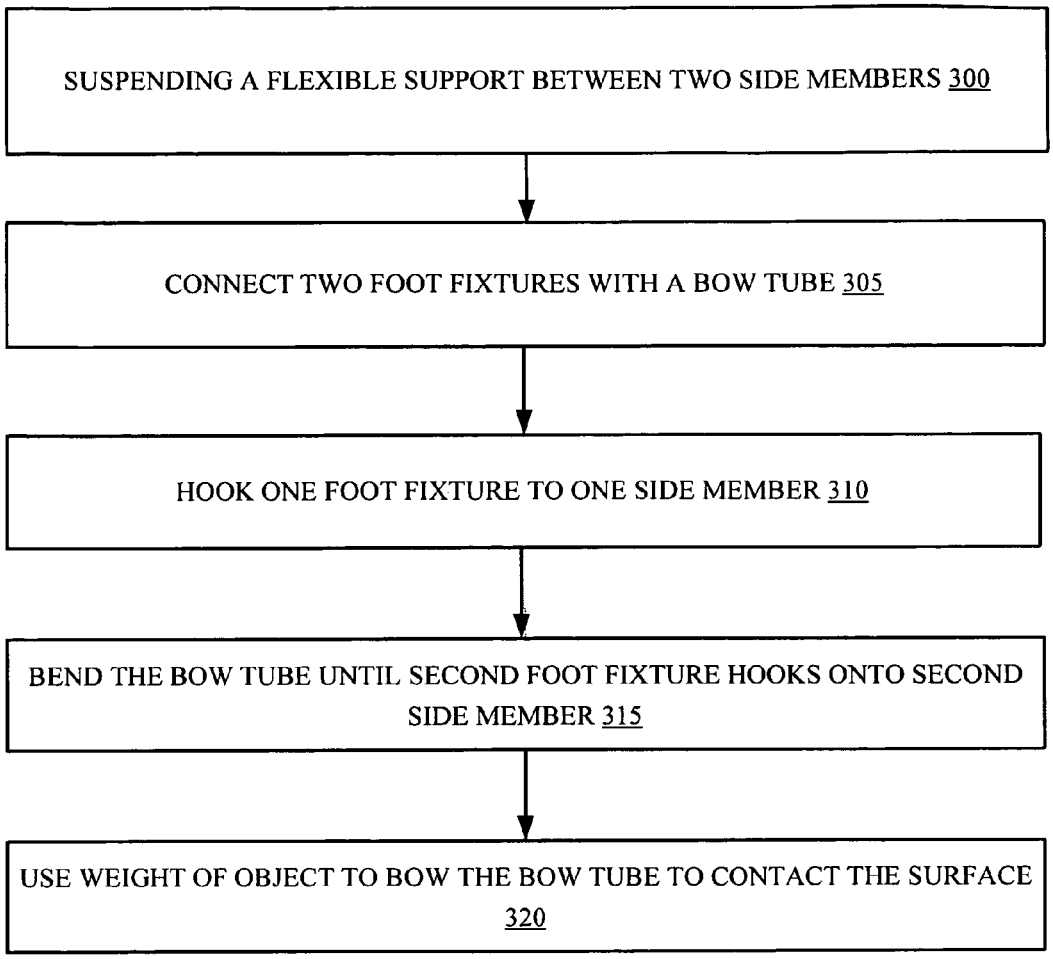
FIG. 17 is a flow chart of another method of supporting an object.

In another embodiment, referring to FIG. 17, the method of supporting an object over a ground surface of may further comprise a step 320 of bowing the bow truss so that it contacts the ground surface using the weight of the object on the flexible support area.

Figure 14:
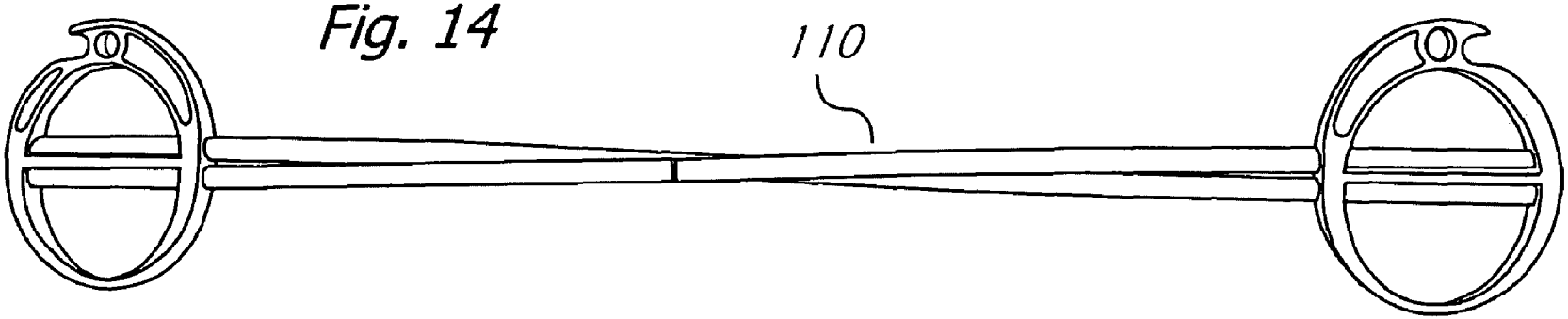
FIG. 14 is an illustration of a bow truss configured with a longer bow tube.

In a further embodiment, referring to FIGS. 13 and 14, the method of supporting an object over a ground surface may include: connecting first ends of two bow tubes into a first foot fixture (see FIG. 13); connecting second ends of the two bow tubes into a second foot fixture; and rotating one of the foot fixtures by 180 degrees (see FIG. 14).

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A convertible support apparatus for supporting an object over a surface, convertible between an operating configuration and a storage configuration, the support apparatus comprising:

two side members;

a support area configured to connect the side members; and a bow truss configured to bow, comprising a first bow tube and two foot fixtures, at least one of the foot fixtures having a hook configured to connect the foot fixture to a side member;

wherein when the device is assembled in the operating configuration and not supporting the object, both the support area and the bow truss are connected between the side members and the bow tube is configured to bow and place the support area under tension;

wherein when the apparatus is placed on a surface in the operating configuration without the object, the two foot fixtures are configured to touch the surface and the bow tube is configured to suspend over the surface out of physical contact with the surface; and wherein, when the support area is loaded with the object, the bow tube will deflect and contact the surface.

2. The convertible support apparatus of claim 1, wherein:

the support area is flexible;

the foot fixture has a first void and a second void; and wherein the voids are configured to receive a plurality of bow tubes, a plurality of side members and the support area when the support apparatus is in a stowed configuration.

3. The apparatus of claim 1, further comprising a second bow tube disposed adjacent to the first bow tube, the foot fixture configured to connect the second bow tube to the side members.

4. The apparatus of claim 3, wherein the second bow tube is twisted around the first bow tube.

5. The apparatus of claim 1, wherein the bow tube comprises a female member and a male member receivable into the female member, and the foot fixture is configured to receive the bow tube.

6. The apparatus of claim 1, wherein the support area is flexible and the apparatus is configured to support the object at a height over the surface and wherein the apparatus weighs less than 1% of the weight of the object it is configured to support.

7. An apparatus for supporting objects or persons, comprising:

two spaced apart side members;

a surface connected between the side members; and a bow truss connected between the side members, the bow truss comprising a first bow tube connected between two foot fixtures and wherein the bow tube is configured to bow when connected between the side members and bias the side members apart and place the surface under tension;

wherein the bow tube comprises a female member and a male member receivable into the female member, the foot fixture configured to receive the bow tube.

8. The apparatus of claim 7, wherein when the apparatus is placed on a flat surface, the foot fixtures touch the surface and support the apparatus and the bow tube is configured to contact the surface and support the apparatus.

9. The apparatus of claim 8, wherein a second bow tube is twisted around the first bow truss.

10. The apparatus of claim 7, further comprising a plurality of bow trusses disposed between the side members.

11. The apparatus of claim 7, wherein the apparatus is convertible between an operating configuration and a storage configuration.

12. A method of supporting an object over a surface, comprising:

suspending a flexible support between two side members;

connecting at least two foot fixtures to the side members, the foot fixtures supporting the side members over a surface;

connecting a bow tube between the foot fixtures;

connecting first ends of two bow tubes into a first foot fixture;

connecting second ends of the two bow tubes into a second foot fixture; and rotating one of the foot fixtures by 180 degrees.

13. The method of supporting an object over a surface of claim 12, further comprising bowing the bow tube so that it contacts the surface by placing the object on the flexible support area.

* * * * *